United States Patent [19]

Ryan et al.

[11] 3,975,014

[45] Aug. 17, 1976

[54] LAWN BOWLING APPARATUS

[76] Inventors: John W. Ryan, 674 Nimes Road, Los Angeles, Calif. 90024; James D. Moore, 6810 Locklenna Lane, Palos Verdes, Calif. 90274

[22] Filed: Feb. 5, 1975

[21] Appl. No.: 547,181

[52] U.S. Cl. ..... 273/45; 273/63 R; 273/58 F

[51] Int. Cl.[2] ..... A63D 1/02; A63D 5/08

[58] Field of Search ..... 273/41, 44, 45, 58 F, 273/63 R, 63 A, 95 R, 106 R, 37, 58 C

[56] References Cited

UNITED STATES PATENTS

| | | | |
|---|---|---|---|
| 1,259,542 | 3/1918 | Makray | 273/45 X |
| 1,722,784 | 7/1929 | Blair | 273/41 |
| 2,017,796 | 10/1935 | Freytag | 273/45 X |
| 2,035,975 | 3/1936 | Meyer | 273/37 X |
| 2,329,344 | 9/1943 | Engstrom | 273/45 X |
| 3,586,325 | 6/1971 | Lorber | 273/44 |
| 3,601,398 | 8/1971 | Brochman | 273/58 C |

FOREIGN PATENTS OR APPLICATIONS

| | | | |
|---|---|---|---|
| 1,149,963 | 7/1957 | France | 273/45 |
| 1,232,820 | 5/1971 | United Kingdom | 273/45 |

*Primary Examiner*—Richard C. Pinkham
*Assistant Examiner*—Harry G. Strappello
*Attorney, Agent, or Firm*—Herzig & Walsh, Inc.

[57] ABSTRACT

The apparatus includes a platform supported by legs at the corners. It supports the bowling pins which are preferably of formed plastic. A ball is used which is a bean bag type ball containing beans or other particulate material and having a cover of a conventional ball. In the game the ball is not rolled but rather is lobbed. Cords are provided attached to the bases of the pins and to a manually operable lever for automatically resetting the pins manually. The cords and lever are fabricated as an integral plastic molded unit the cords being in the form of flat strips. The pins are of hollow molded construction. Each has a bottom slot opening adapted to receive and anchor a molded joint or barb on the end of a cord.

4 Claims, 14 Drawing Figures

FIG. 1
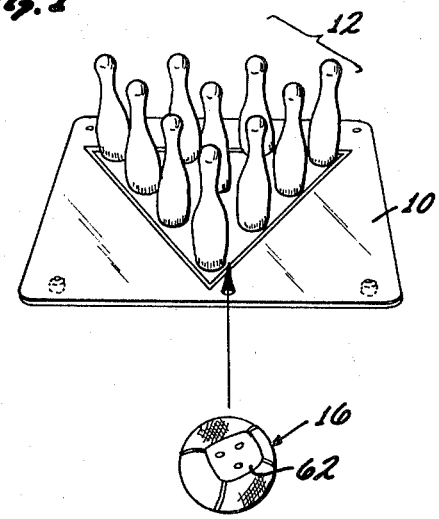
FIG. 2
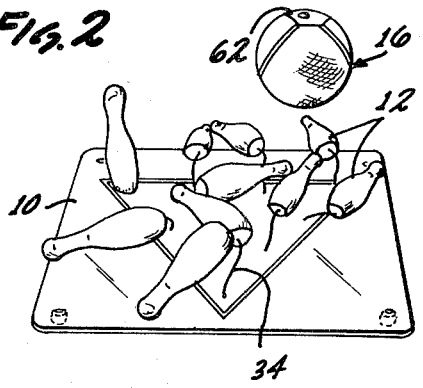
FIG. 3
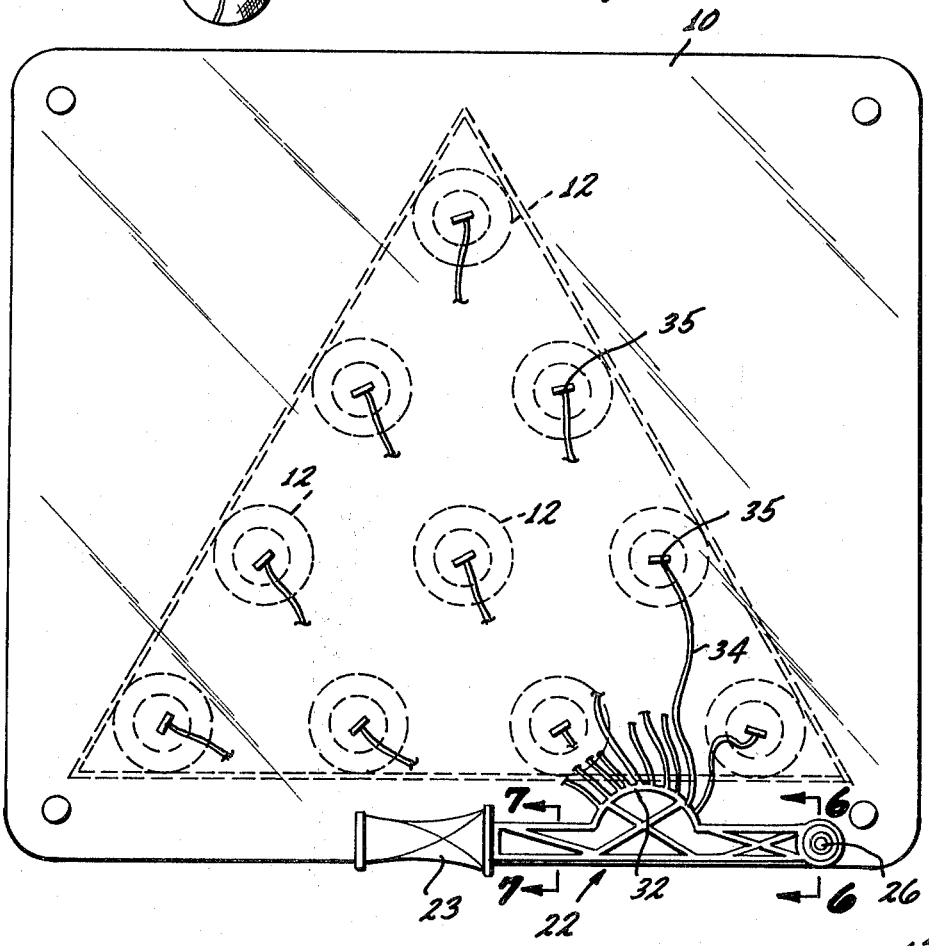
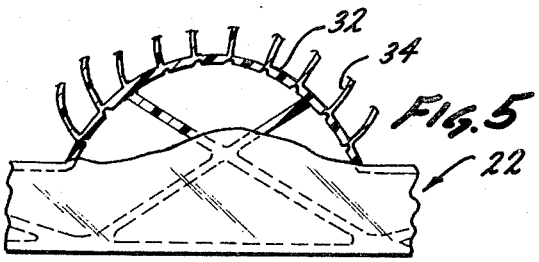
FIG. 5
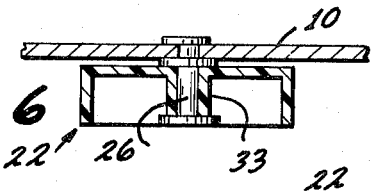
FIG. 6
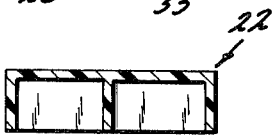
FIG. 7

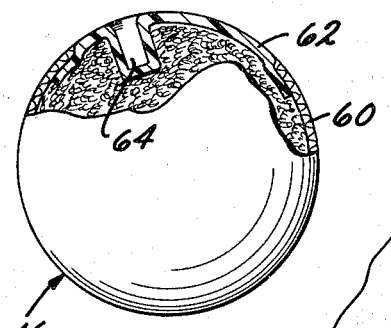
FIG. 8
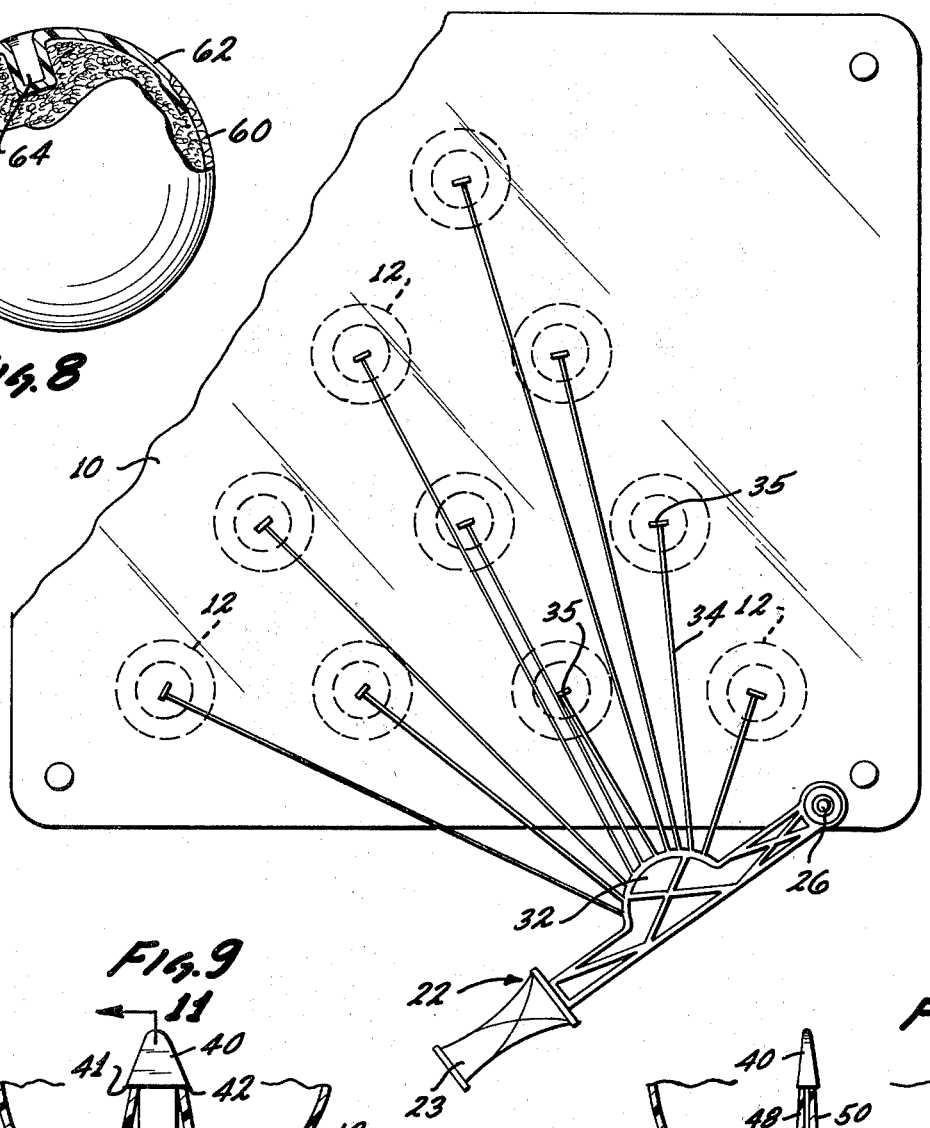
FIG. 4
FIG. 9
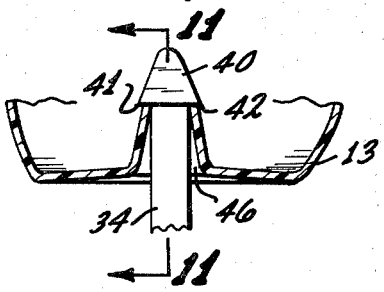
FIG. 11
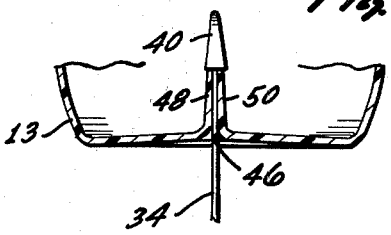
FIG. 12
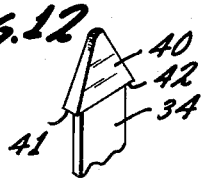
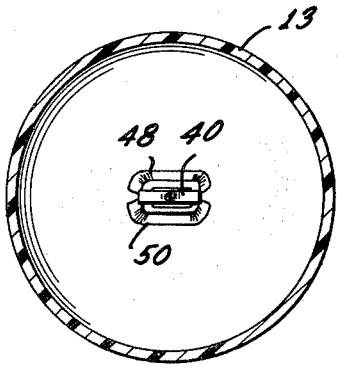
FIG. 10
FIG. 13
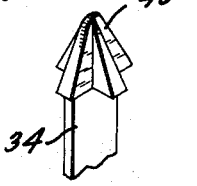
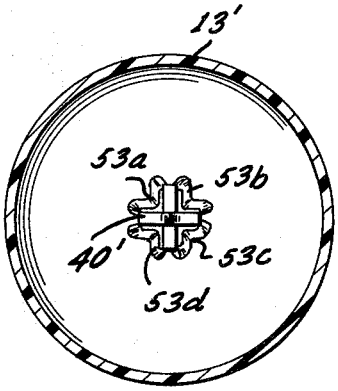
FIG. 14

LAWN BOWLING APPARATUS

BACKGROUND OF THE INVENTION

1. Field of the Invention

The field of the invention is that indicated in the abstract. It is a lawn bowling game which possesses unique features as described in more detail hereinafter. The field of the invention is that of games adapted to use in the average back yard. The improvements reside primarily in the fabrication and assembly of parts.

2. Description of the Prior Art

Typical amateur and professional indoor bowling is of course well known to the art. Lawn bowling as such practiced on lawn surfaces is known also. To the extent that lawn bowling is known, however, it is subject to a number of deficiencies and drawbacks. Uneven and irregular lawn surfaces causes inconsistent and unnatural ball rolling. As to the pins used particularly light weight plastic pins typical of known home games, they are very difficult to stand on a lawn surface and have different degrees of stability each time they are set. Resetting them is an inconvenient problem. Further, when the ball hits the pins in conventional lawn bowling, there is a minimum of sound especially typical of the pin mixing that occurs in an ordinary bowling alley. It is time consuming to set up the pins even with a template with the result that ordinarily more time is consumed setting up the pins than in playing the game.

Further, a normal ball is conventionally used, even a light weight ball when thrown hard enough to roll to the pins, keeps right on rolling and requires a back stop or long chase to recover. Thus, as may be seen, the prior art in the field to the extent known, lacks effectiveness and is subject to disadvantages as pointed out and is not convenient or easy to set up in the ordinary back yard. Further, the prior art lacks the specific improvements particularly in the way of fabrication and assembly of parts as outlined in detail hereinafter.

SUMMARY OF THE INVENTION

The field of the invention has been identified in the foregoing and the invention has been summarized in the abstract.

In the preferred exemplary form of the invention as described in detail herein, it takes the form of a rectangular platform supported on relatively short legs. The pins are of light weight molded plastic construction. A cord is attached to the base of each pin. These cords are attached to a manually actuatable lever so that by manually pulling the lever and tensioning the cords which pass through holes in the platform, all the pins can quickly and easily be set. A unique improvement resides in that the lever and cords are molded as an integral unit thereby greatly simplifying fabrication and assembly.

The ball used in the game is not a typical type of bowling ball but is instead a relatively heavy bean bag and is lobbed rather than rolled. Preferably the ball has a relatively flexible cover with a more rigid portion or segment which has in it holes corresponding to regular bowling ball finger holes.

Preferably the platform or board is two or three inches off the ground and is constructed and designed so as to radiate the sound from the pins falling and hitting each other.

A primary object is to provide pin resetting means having cords attached to the pins and to a manually actuatable member for automatically resetting the pins with one manual motion, wherein the cord members attached to the pins and the manually actuatable lever are fabricated as an integral unit by way of a molding process.

A further object is to provide improved attachment means for attaching the molded cord members to the pins embodying a slot-like opening in the bottom of the pins adapted to receive the end of the molded cord member having an end piece providing shoulders which anchor over the hole forming the slot in the bottom of the pins.

Further objects and additional advantages of the invention will become apparent from the following detailed description and annexed drawings wherein:

FIG. 1 is a pictorial view of a preferred form of the invention;

FIG. 2 is a view similar to that of FIG. 1 wherein the pins are down and illustrating a ball;

FIG. 3 is a bottom view of the platform of the game showing the pin resetting means;

FIG. 4 is a view like FIG. 3 illustrating actuation of the pin resetting means;

FIG. 5 is a partial view of the integrally molded pin resetting lever and cords;

FIG. 6 is a sectional view taken along the line 6—6 of FIG. 3;

FIG. 7 is a sectional view taken along the line 7—7 of FIG. 3;

FIG. 8 is a view partly in section of a preferred form of a bean bag ball;

FIG. 9 is a sectional view of a bottom part of a pin illustrating attachment of a cord;

FIG. 10 is a transverse sectional view of the bottom of the pin showing the cord attachment;

FIG. 11 is a sectional view taken along the line 11—11 of FIG. 9;

FIG. 12 is a detail view of the end point or configuration on the end of the molded cord;

FIG. 13 is a detail view of a modified form of end configuration at the end of the cord;

FIG. 14 is a sectional view like that of FIG. 10 illustrating a modified configuration.

DESCRIPTION OF THE PREFERRED EMBODIMENT

Referring to FIGS. 1–4, numeral 10 designates a rectangular board or support platform made from a stiff material which may be wood, plastic, or the like. The board has corner legs or posts at the corners to support the board 10 two or three inches from the ground. The board provides a smooth flat surface for the pins to set upon so that each toss of the ball is consistent. The board is designed to radiate the sound from the pins falling and hitting each other. This provides a realistic audio feedback to the players.

The pins are designated generally by the numeral 12. The pins are of a conventional configuration and are of a size appropriate to the size of the board or platform.

Preferably the pins may be of a lightweight molded plastic construction having a configuration at the lower part as designated at 13 in FIGS. 9–11 which will be referred to again presently.

The bean bag ball is illustrated at 16 and partly in section in FIG. 8 and will be described in more detail presently.

FIG. 3 shows the bottom of the board there being a hole in the board at the setup position of each pin as illustrated. Cord members pass through the holes in the board and are attached to the bottoms of the pins. The cords attach to a lever which is pivoted and which can be swung manually about its pivot to tension all of the cords to automatically set up the pins. This is illustrated in FIG. 1–4.

In the preferred exemplary form of the invention as described in detail herein, the lever and the cord members are molded as an integral assembly. The lever is designated at 22. It has formed handle part 23. It is pivoted on a pivot stem 26 extending from the board 10. The molded configuration of the lever 22 may be seen in the figures. It is of channel section as may be seen having internal ribs strengthening it as illustrated and having a tubular boss 33 journalled on the pin 26.

At an intermediate part of the lever 22 it has an arcuate extended part 32 to which the cords in the form of integrally molded flat strips are integrally attached as illustrated in the figures, one of the cords being identified by the numeral 34. The cord is in the form of a thin flat strip, and the openings as designated at 35 in FIG. 3 being in the form of slots.

The cords are of predetermined lengths, so that when the lever 22 is actuated as illustrated in FIG. 4 the pins are simultaneously pulled to an upright position as illustrated in FIGS. 1 and 2.

FIGS. 9–12 illustrate preferred constructions for providing the attachment or securement of the cord members 34 to the bottom of the pins. The pins are of hollow construction as illustrated. In FIGS. 9–12 the flat molded cord 34 has at its end an integral molded point 40 configurated as shown so as to provide side shoulders 41 and 42. Pin 13 is hollow and formed in the bottom is a slot 46, upstanding from the bottom of the pin 13 are integral upright members 48 and 50 having a cross-sectional configuratin as illustrated in FIG. 10. The point 40 at the end of the flat strip cord member 34 is insertable through the slot 46 until the pointed end 40 passes above the top edges of the upstanding members 48 and 50 and then the shoulders 41 and 42 on point 40 anchor over these top edges as illustrated. Thus, as can be seen, the pin resetting mechanism can be fabricated in a simplified and economical way which allows for easy assembly of all the parts which are then held together but yet readily operable by a simple manual movement for resetting.

FIG. 13 is a form of attaching cord 34 of modified form of end point 40′, which is cruciform as shown having diametrically opposed ribs providing four peripheral shoulders rather than two as in FIG. 12. The opening in the bottom of the pin as illustrated in FIG. 14 is formed to accommodate this cruciform type of point as shown in FIG. 13, the members upstanding from the opening as illustrated at 53*a*, *b*, *c* and *d* in FIG. 14 to accommodate the cruciform point 40′ at the end of the cord member.

FIG. 8 shows a preferred form of the ball which may be of a size appropriate to the size of the pins. As shown, it is generally spherical but it may have other shapes. As shown it has an outer covering 60 which may be either rubber, plastic, or otherwise. The covering is flexible and has a segment in one area designated at 62 which is more rigid and which is provided with finger holes as designated at 64 which are formed as integral tubular portions extending inwardly toward the interior of the ball. The bean bag ball may contain various types of particulate material such as beans or other comparable material. The finger holes may be formed of plastic having appropriate rigidity, to aid in the holding, throwing and spinning of the ball to effect additional pin action when hit. The more rigid area may comprise approximately ¼ of the surface of the ball.

The utilization of the apparatus of the invention will be readily apparent to those skilled in the art. All of the parts are connected together as described and the platform may be set up in the typical back yard. The game is then played by lobbing the ball at the pins following appropriate rules comparable to typical bowling. None of the disadvantages which are attendant to lawn bowling as known in the prior art and as previously referred to are present in the apparatus of the invention. The pins as illustrated in FIG. 2 are reset simply by manipulation of the handle 22 as illustrated in FIG. 4.

From the foregoing, those skilled in the art will readily understand the nature and construction of the invention and the manner in which all of the objects as set forth in the foregoing are realized.

The foregoing disclosure is representative of a preferred form of the invention and is to be interpreted in an illustrative rather than a limiting sense, the invention to be accorded the full scope of the claims appended hereto.

We claim:

1. Game apparatus comprising a platform and means to support it at a predetermined level, a group of playing pins to be set on the platform and means providing connections between the pins and platform allowing them to be knocked down and set up, the connections to the pins including cords secured to the bottom of each pin passing through openings in the platform, and manual means attached to the cords whereby upon manipulation of the manual means all pins can be simultaneously set up, the manual means comprising a lever having a pivotal attachment to the platform, each of said pins being hollow having a bottom opening, each of said cords having an end part configurated to pass through the bottom opening in the pin and then to anchor on the inside of the pin, said lever and cords being of integral molded construction, the lever being rigid and the cords being in the form of molded thin plastic strips.

2. Game apparatus as in claim 1 wherein the said bottom opening is in the form of a slot having sidewalls, each cord having an end configuration providing shoulders adapting it for insertion through the slot and for the shoulders to anchor against the said side members.

3. Game apparatus as in claim 2 wherein said sidewalls are flexible to allow insertion of the end configuration.

4. Game apparatus as in claim 3 wherein each cord is a flat strip, the end configuration being in the form of a flat point having bottom corners forming said shoulders.

* * * * *